US010787826B2

(12) United States Patent
Schneider

(10) Patent No.: US 10,787,826 B2
(45) Date of Patent: Sep. 29, 2020

(54) SUPPORT HEAD, CEILING SUPPORT, AND CEILING FORMWORK HAVING SUCH A CEILING SUPPORT

(71) Applicant: PERI GMBH, Weissenhorn (DE)

(72) Inventor: Werner Schneider, Erbach (DE)

(73) Assignee: PERI GMBH, Weissenhorn (DE)

( * ) Notice: Subject to any disclaimer, the term of this patent is extended or adjusted under 35 U.S.C. 154(b) by 77 days.

(21) Appl. No.: 15/777,324

(22) PCT Filed: Nov. 29, 2016

(86) PCT No.: PCT/EP2016/079093
§ 371 (c)(1),
(2) Date: May 18, 2018

(87) PCT Pub. No.: WO2017/093231
PCT Pub. Date: Jun. 8, 2017

(65) Prior Publication Data

US 2018/0328053 A1 Nov. 15, 2018

(30) Foreign Application Priority Data

Nov. 30, 2015 (DE) ..... 10 2015 223 773

(51) Int. Cl.
*E04G 11/48* (2006.01)
*E04G 11/38* (2006.01)

(52) U.S. Cl.
CPC ..... *E04G 11/483* (2013.01); *E04G 11/38* (2013.01)

(58) Field of Classification Search
CPC ..... E04G 11/36; E04G 11/38; E04G 11/48; E04G 11/483; E04G 11/486; E04G 11/50; E04G 2011/505
USPC ..... 249/18, 26, 28
See application file for complete search history.

(56) References Cited

U.S. PATENT DOCUMENTS 5,614,122 A * 3/1997 Schworer ..... E04G 11/486 249/210
5,935,482 A 8/1999 Schwoerer
8,430,374 B2 * 4/2013 Kurth ..... E04G 11/50 249/18
8,523,137 B2 * 9/2013 Schworer ..... E04G 11/483 249/18
8,616,519 B2 * 12/2013 Bacon ..... E04G 11/483 249/18

(Continued)

FOREIGN PATENT DOCUMENTS

DE 8102761 U1 7/1981
DE 3024580 A1 1/1982

(Continued)

*Primary Examiner* — Michael Safavi
(74) *Attorney, Agent, or Firm* — Lucas & Mercanti, LLP; Klaus P. Stoffel

(57) ABSTRACT

A support head and a ceiling support. The support head in particular has a plate-shaped design and has multiple guide tabs. The guide tabs are arranged or provided in such a way that a formwork element is secured on the support head so as to prevent shifting, preferably at various positions. The support head has widely opened first guide tabs that are situated opposite from less widely opened guide tabs. This asymmetry of the support head allows the support head to be situated close to a wall corner, while at the same time the formwork element can be easily fastened.

13 Claims, 7 Drawing Sheets

(56) References Cited

U.S. PATENT DOCUMENTS

| | | | | |
|---|---|---|---|---|
| 10,053,875 | B1 * | 8/2018 | Baron | E04G 11/50 |
| 10,407,925 | B2 * | 9/2019 | Baron | E04G 11/50 |
| 2004/0075042 | A1 * | 4/2004 | Arozena Bergaretxe | E04G 11/486<br>249/210 |
| 2007/0209297 | A1 * | 9/2007 | Schwoerer | E04G 11/38<br>52/127.1 |
| 2009/0294627 | A1 * | 12/2009 | Schwoerer | E04G 11/483<br>249/18 |

FOREIGN PATENT DOCUMENTS

| | | | | |
|---|---|---|---|---|
| DE | 4204788 | A1 * | 8/1993 | E04G 11/483 |
| DE | 4204788 | A1 | 8/1993 | |
| DE | 4308607 | A1 * | 9/1994 | E04G 11/486 |
| DE | 19720728 | A1 | 11/1998 | |
| DE | 10324022 | A1 | 12/2004 | |
| EP | 0878595 | A1 | 11/1998 | |
| EP | 2458111 | A2 | 5/2012 | |
| EP | 2759658 | A1 | 7/2014 | |
| GB | 2266114 | A * | 10/1993 | E04G 11/486 |
| WO | 2006108495 | A1 | 10/2006 | |

* cited by examiner

SUPPORT HEAD, CEILING SUPPORT, AND CEILING FORMWORK HAVING SUCH A CEILING SUPPORT

CROSS-REFERENCE TO RELATED APPLICATIONS

The present application is a 371 of International application PCT/EP2016/079093, filed Nov. 29, 2016, which claims priority of DE 10 2015 223 773.7, filed Nov. 30, 2015, the priority of these applications is hereby claimed and these applications are incorporated herein by reference.

BACKGROUND OF THE INVENTION

The invention relates to a support head for a ceiling support for a ceiling formwork, wherein the support head comprises the following:

a) a connecting area in which the support head is connectable to a formwork support or is connected to the formwork support;

b) a support plane for supporting a formwork element of the ceiling formwork and/or a beam of the ceiling formwork;

c) guide tabs that protrude away from the connecting area, the guide tabs having a design that opens outwardly from the connecting area.

The invention further relates to a ceiling support having such a support head, and a ceiling formwork having such a ceiling support.

It is known to use formwork elements for producing concrete ceilings. In particular frame panel formwork elements, which at least partially form a mold for filling liquid concrete, are used. The formwork elements are removed after the concrete has hardened.

The formwork elements are supported by ceiling supports. Different ceiling supports or ceiling supports having different support heads are used, depending on the particular position at which the formwork elements are supported by the ceiling support. On the one hand, ceiling supports with large capture areas are used, on which formwork elements may be easily mounted from below. On the other hand, compact ceiling supports are used which allow the ceiling support to be set up close to a wall or a wall corner to be able to position a formwork element flush against a wall or in the wall corner.

SUMMARY OF THE INVENTION

Accordingly, an object of the present invention is to provide a support head, a ceiling support, and a ceiling formwork having such a ceiling support, wherein the support head is preferably universally usable. A further object of the invention is to provide a method for putting up such a ceiling formwork.

The object according to the invention is thus achieved by a support head. The support head has a connecting area on which the support head is mountable on the formwork support. The support head also has a support plane. The support plane is preferably designed in the form of a surface of a support plate. Guide tabs protrude from the connecting area at two opposite sides of the support head. The guide tabs represent a capture area for exactly positioning formwork elements on the support head. First guide tabs on the first side of the support head form a larger capture area than second guide tabs on the second side of the support head.

The ends of the first guide tabs preferably protrude farther away from the connecting area than do the ends of the second guide tabs.

The support head is thus asymmetrical with respect to a plane that extends perpendicularly relative to the support plane and through the connecting area.

With the second side, which has less widely opened second guide tabs, the support head may be situated close enough to a wall corner that a formwork element connected to the support head can rest flush against the wall corner. In addition, a formwork element may be easily mounted on the second side due to the fact that the second guide tabs are widely opened. It is thus not necessary to provide different support heads for different installation situations.

The formwork element may be suspended in the guide tabs of the support head and subsequently swiveled out from the floor.

The first guide tabs preferably have a design that, starting from the connecting area, is more widely opened, i.e., spread farther apart, in the radial direction than the second guide tabs. The first guide tabs and the second guide tabs preferably form lateral guides of insertion openings of the support plane, in particular insertion openings of a support plate.

The guide tabs preferably each have at least one protrusion for engaging behind a formwork element in order to prevent the formwork element from lifting up perpendicularly with respect to the support plane, and to allow the formwork element to be securely mounted.

The first guide tabs are preferably designed in the form of a first guide tab pair and a second guide tab pair, and the second guide tabs are preferably designed in the form of a third guide tab pair and a fourth guide tab pair.

To be able to centrally support a formwork element on a longitudinal side, the first guide tab pair together with the third guide tab pair preferably forms a first channel guide, and the second guide tab pair together with the fourth guide tab pair preferably forms a second channel guide. A frame section of a formwork element is selectively accommodatable in the two channel guides.

The support head may have at least one spacer tab, in particular one first spacer tab pair, between the first guide tabs and the second guide tabs. The spacer tab together with the first guide tabs preferably defines a third channel guide, and together with the second guide tabs preferably defines a fourth channel guide. The support head may thus selectively accommodate a frame section of a formwork element in the third channel guide or in the fourth channel guide in order to serve as a central longitudinal side support for formwork elements.

The first channel guide, the second channel guide, the third channel guide, and the fourth channel guide preferably have the same width. The second channel guide is preferably spaced apart from the first channel guide by the same distance that the fourth channel guide is spaced apart from the third channel guide. The support head may thus be rotated by 90° relative to a rotational axis that extends perpendicularly with respect to the support plane in order to be used to centrally support a formwork element. This embodiment of the support head also allows accommodation of formwork elements having different orientations; i.e., the longer sides of two formwork elements adjacently supported on the support head may be rotated by 90° relative to one another. This embodiment of the support head also allows accommodation of formwork elements having different orientations; i.e., the longer sides of two formwork elements adjacently supported on the support head may be rotated by 90° relative to one another.

The support head may have a spacer protrusion or multiple spacer protrusions between the spacer tabs. The spacer protrusion or the spacer protrusions allow(s) a beam that is placed on the spacer protrusion or the spacer protrusions to be spaced apart from the support plane. As a result, the beam does not collide with the spread-apart guide tabs of the support head. The spacer protrusion may protrude from the support plane, perpendicularly with respect to the support plane, at least as far as do the guide tabs.

In one particularly preferred embodiment of the invention, the support head has at least one first beam insertion area in which a beam is partially accommodatable. The first beam insertion area preferably has lateral guides for tilt stabilization of the beam, so that a beam that is mounted on the first beam insertion area may be walked on without the risk of an accident. The lateral guides may be designed in the form of tabs. The support head may also have a second beam insertion area, in particular having lateral guides for tilt stabilization of a beam. The lateral guides may be designed in the form of tabs. The first beam insertion area and/or the second beam insertion area are/is preferably designed in the form of through recesses in the support plane. The first beam insertion area may be provided between the first guide tab pair and the second guide tab pair, and the second beam insertion area may be provided between the third guide tab pair and the fourth guide tab pair.

In another preferred embodiment of the invention, the connecting area has a bayonet receptacle to allow a formwork support to be fastened by a bayonet connection.

To prevent inadvertent opening of the bayonet connection, the bayonet receptacle may have anti-twist protection, in particular in the form of a screw lock mechanism, a detent lock mechanism, a wedge lock mechanism, and/or a spring-loaded lock mechanism.

The object according to the invention is achieved by a ceiling support, which in addition to the support head described above has a formwork support that is situated on the support head. The formwork support may be connected to the support head via the bayonet connection.

The invention further relates to a ceiling formwork having a ceiling support described above.

The ceiling formwork preferably has a formwork element that is situated on the ceiling support.

The formwork element may have at least one connecting protrusion behind which a guide tab may engage. Alternatively or additionally, two connecting protrusions may rest against the first spacer tab on either side.

The ceiling formwork may have a beam. The beam may have a hook in the form of a curved finger at each of its two lengthwise ends, a portion of a first hook being inserted into the first beam insertion area. The first hook preferably has an interior bevel that extends at an angle with respect to the longitudinal axis of the beam. The first hook may thus be mounted on the support head with a clearance fit, the beam in the mounted state being pulled by its weight force toward the center of the support head. Due to the clearance fit, the beam is mountable on the set-up ceiling support from below. The two hooks preferably have a mirror-image design with respect to one another.

The object is further achieved by a method for putting up a ceiling formwork, previously described. The ceiling formwork has a formwork surface made up of multiple formwork elements. For putting up the ceiling formwork, at least two ceiling supports may be used, a first of these ceiling supports supporting the formwork surface at a corner of the formwork surface, and a second ceiling support supporting the formwork surface in a center area of the formwork surface spaced apart from the edge and the corners, and in particular a third ceiling support supporting the formwork surface at its edge, wherein the third ceiling support supports the formwork surface at its edge in such a way that the formwork shell covers the support head, either at least virtually completely, or at most up to the center of the connecting area. According to the invention, it is thus provided to use identical ceiling supports for supporting all areas of the formwork surface.

Further features and advantages of the invention result from the following description of several exemplary embodiments of the invention, from the patent claims, and from the figures of the drawing, which show particulars essential to the invention.

The features shown in the drawing are illustrated in such a way that the special characteristics according to the invention may be made clearly apparent. The various features may be implemented in variants of the invention, either singly, or collectively in arbitrary combinations.

DETAILED DESCRIPTION OF THE INVENTION

Figure 1:
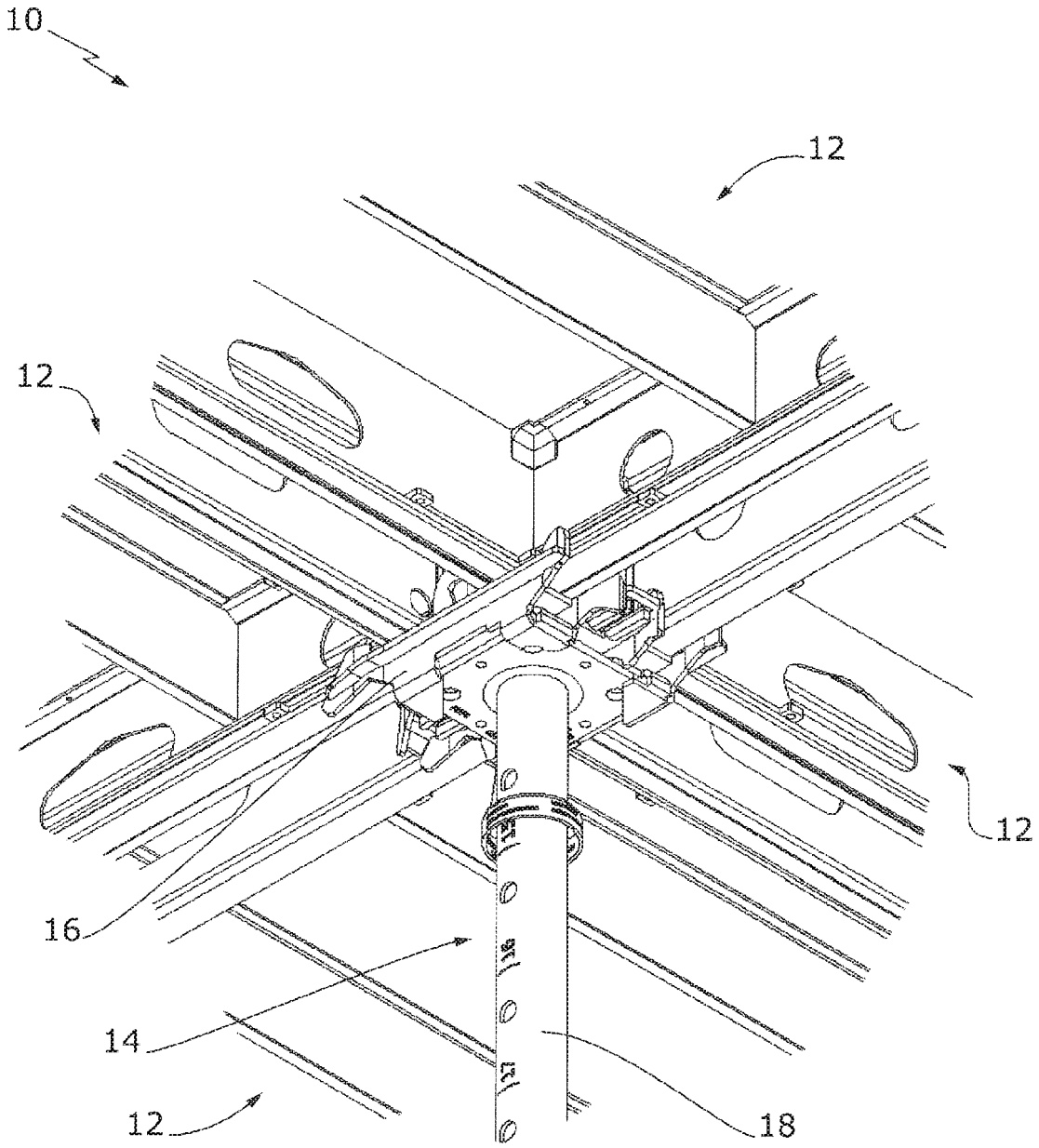
FIG. 1 shows a perspective view of a ceiling formwork together with a ceiling support that has a support head.

FIG. 1 shows a ceiling formwork 10 comprising four formwork elements 12 and a ceiling support 14. The ceiling support 14 has a support head 16 that is connected to a formwork support 18. In the present example, the formwork elements 12 each rest at their corners on the support head 16.

Figure 2:
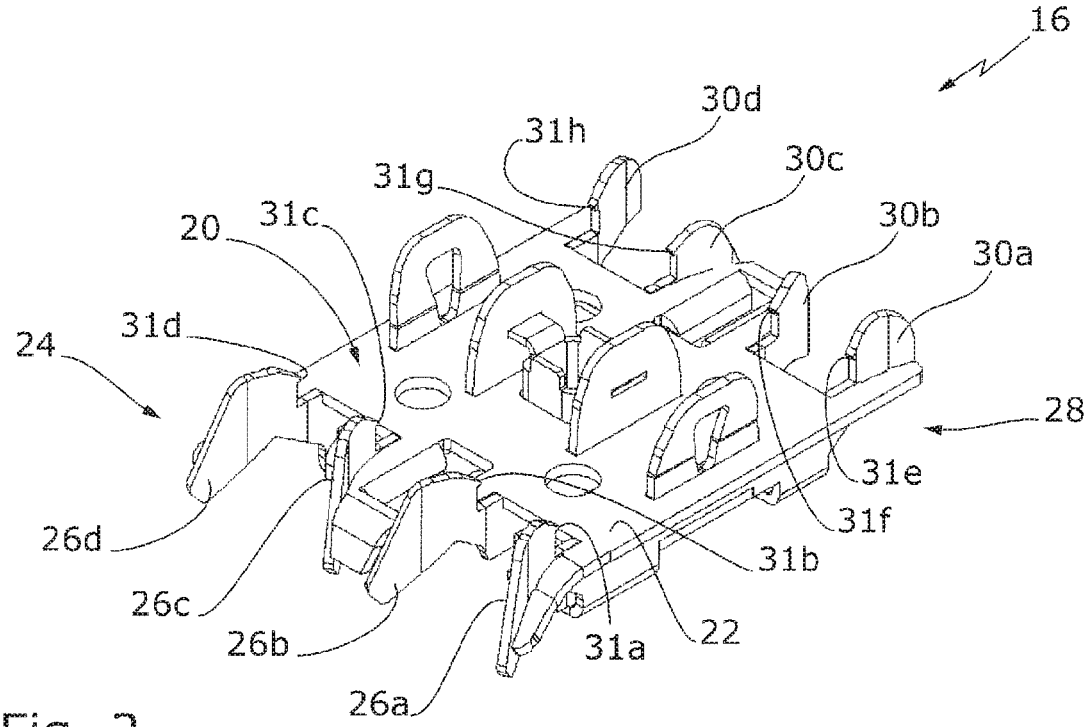
FIG. 2 shows a perspective view of the support head from FIG. 1.

FIG. 2 shows the support head 16 by itself. The support head 16 is formed from sheet steel that is partially cut to shape and partially bent. The support head 16 has a support plate 20 whose top side forms a support plane 22 in the mounted state of the support head 16. First guide tabs 26*a-d* are provided on the support plate 20 on a first side 24. Second guide tabs 30*a-d* are provided on a second side 28 situated opposite from the first side 24. The first guide tabs 26*a-d* are spread apart farther than are the second guide tabs 30*a-d*. Fastening a formwork element 12 (see FIG. 1) from a great distance is thus much easier on the first side 24 than on the second side 28.

It is apparent from FIG. 2 that the guide tabs 26*a-d*, 30*a-d* in each case have protrusions 31*a-h* to allow the support head 16 to engage behind the formwork elements 12.

Figure 3:
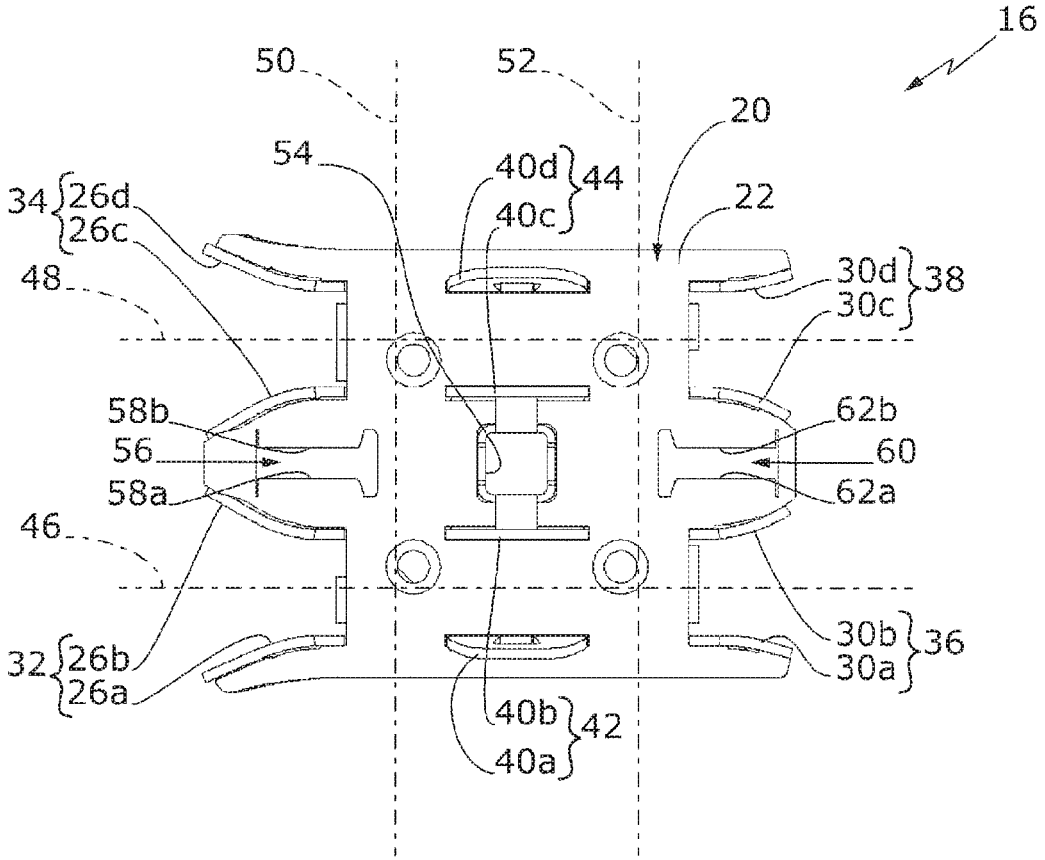
FIG. 3 shows a top view of the support head from FIG. 2.

FIG. 3 shows the support head 16 according to FIG. 2 in a top view. It is apparent from FIG. 3 that the first guide tabs 26*a-d* form a first guide tab pair 32 and a second guide tab pair 34. The second guide tabs 30*a-d* form a third guide tab pair 36 and a fourth guide tab pair 38. The support head 16 has spacer tabs 40*a-d* between the first guide tabs 26*a-d* and the second guide tabs 30*a-d*. The spacer tabs 40*a*, 40*b* form a first spacer tab pair 42, and the spacer tabs 40*c*, 40*d* form a second spacer tab pair 44.

The first guide tab pair 32 together with the third guide tab pair 36 and the first spacer tab pair 42 defines a first channel guide 46. The second guide tab pair 34 together with the fourth guide tab pair 38 and the second spacer tab pair 44 defines a second channel guide 48. In addition, the space between the first guide tab pair 32 and the first spacer tab pair 42, as well as the space between the second guide tab pair 34 and the second spacer tab pair 44, define a third channel guide 50. Lastly, the space between the third guide tab pair 36 and the first spacer tab pair 42, as well as the space between the fourth guide tab pair 38 and the second spacer tab pair 44, define a fourth channel guide 52. The channel guides 46, 48, 50, 52 form options for frame sections to accommodate formwork elements 12 (see FIG. 1). The channel guides 46, 48, 50, 52 preferably delimit a square. More preferably, the channel guides 46, 48, 50, 52 are provided centrally with respect to a connecting area 54 of the support head 16. The support head 16 may thus be situated on formwork elements 12, in the position shown in FIG. 1, or rotated by 90° in the support plane 22.

A first beam insertion area 56 with lateral guides 58*a*, 58*b* in the form of tabs is provided in the support plate 20, between the first guide tab pair 32 and the second guide tab pair 34. In addition, a second beam insertion area 60 with lateral guides 62*a*, 62*b* in the form of tabs is provided in the support plate 20, between the third guide tab pair 36 and the fourth guide tab pair 38. Beams 90 are fastenable in the beam insertion areas 56, 60 in a tilt-proof manner (see FIGS. 13 through 15).

Figure 4:
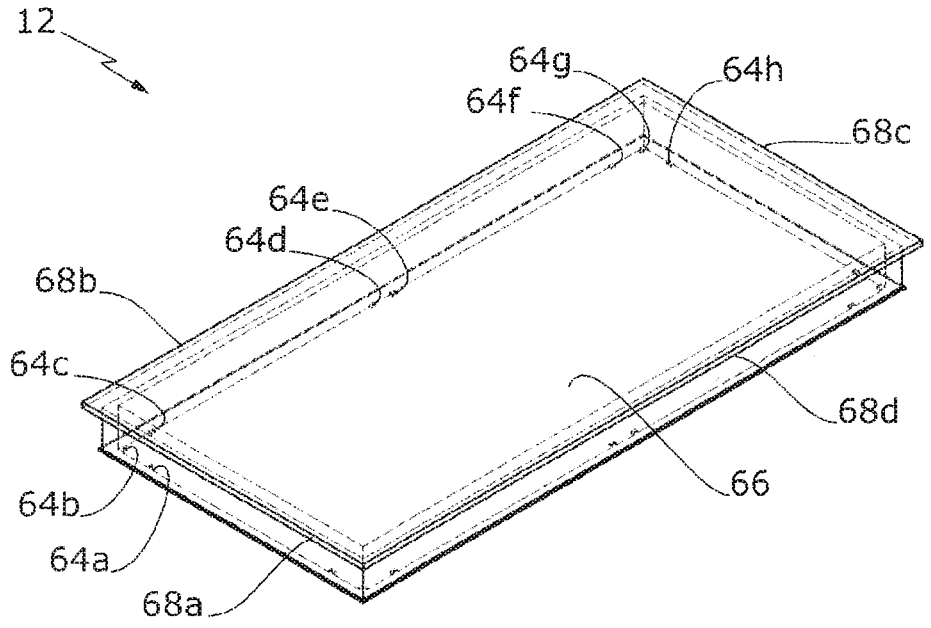
FIG. 4 shows a perspective view of a formwork element of a ceiling formwork.

FIG. 4 shows a view of a formwork element 12. It is apparent from FIG. 4 that the formwork element 12 has connecting protrusions, of which only the connecting protrusions 64*a-h* are provided with reference numerals for reasons of clarity. The connecting protrusions 64*a-h* are used for positioning support heads 16 (see FIG. 1) or support heads 16*a-f* (see FIG. 5) on the formwork element 12 with a precise fit.

The formwork element 12 has outer abutment faces 68*a-d* in the plane of a formwork shell 66, which in the mounted state abut on a wall (not shown), or in the case of multiple identical formwork elements 12, abut against one another in flush alignment.

Figure 5:
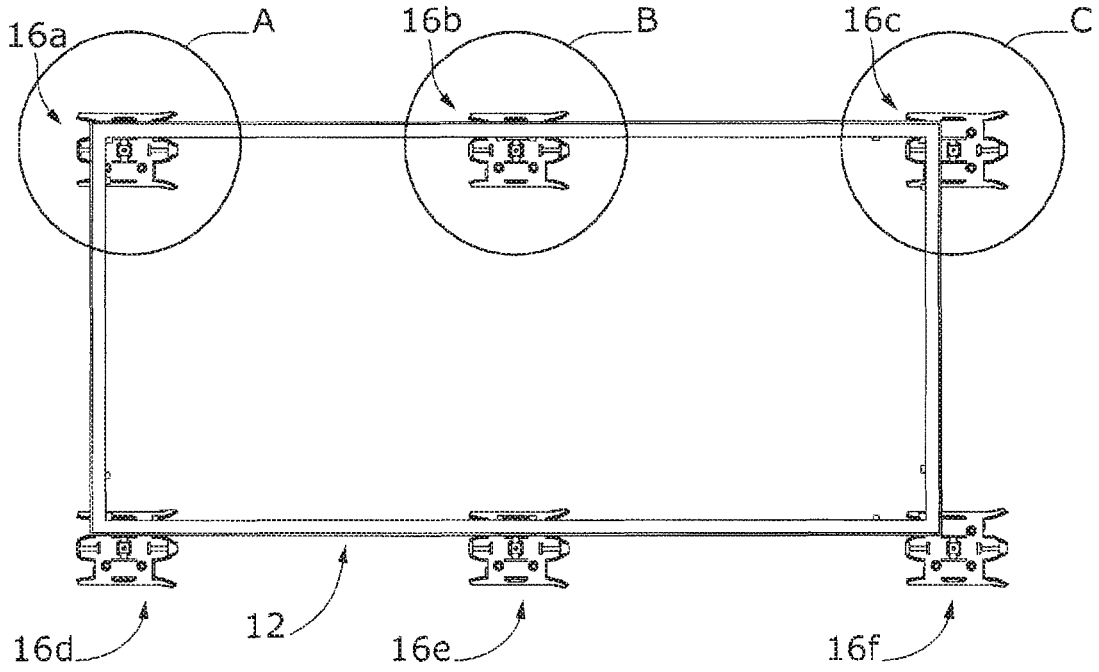
FIG. 5 shows a sectional top view of a ceiling formwork having multiple support heads.

FIG. 5 shows support heads 16*a-f* on the formwork element 12 according to FIG. 4. The support head 16*a* is maximally covered by the formwork element 12. The abutment faces 68*a*, 68*b* not visible in FIG. 5 (see FIG. 4) are in flush alignment with the farthest protruding portions of the support head 16*a*. In this way, the support head 16*a* together with the formwork element 12 may be situated flush in a wall corner (not shown).

In contrast, the formwork element 12 is only partially supported on the support heads 16*c*, 16*d*, 16*f*, so that further formwork elements 12 (see FIG. 1; not shown in FIG. 5) may be attached to the support heads 16*c*, 16*d*, 16*f*.

The support heads 16*b*, 16*e* are used to centrally support the formwork element 12 for very heavy roofs to be concreted. The support head 16*b* does not protrude beyond the formwork element 12, so that the formwork element 12 may be positioned directly on a wall or in parallel to a wall. A further formwork element 12 (not shown in FIG. 5) may be attached to the support head 16*e*.

Figure 6:
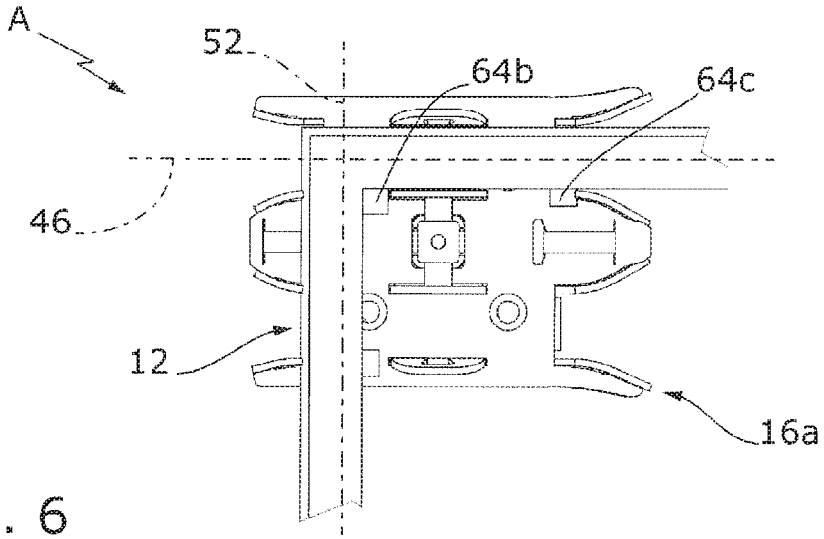
FIG. 6 shows an enlarged view of area A from FIG. 5.

FIG. 6 shows an enlarged detail A from FIG. 5. It is apparent from FIG. 6 that the formwork element 12 is positioned in the first channel guide 46 and in the fourth channel guide 52. Connecting protrusions 64*b*, 64*c* ensure exact placement of the formwork element 12 on the support head 16*a*. The connecting protrusions 64*a-c* are preferably part of an angled metal sheet of the formwork element 12.

Figure 7:
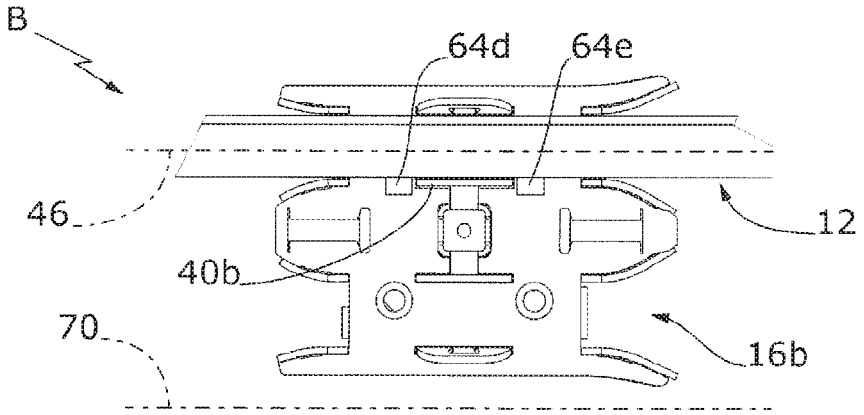
FIG. 7 shows an enlarged view of area B from FIG. 5.

FIG. 7 shows an enlarged detail B from FIG. 5. It is apparent from FIG. 7 that the formwork element 12 is held in the first channel guide 46 on the support head 16*b*. The formwork element 12 is positioned by connecting protrusions 64*d*, 64*e* that rest against the spacer tab 40*b*. The formwork element 12 is thus fixed relative to the support head 16*b*, in the direction of the longitudinal axis 70 of the formwork element 12. The connecting protrusions 64*d*, 64*e* are preferably part of a sheet metal strip of the formwork element 12.

Figure 8:
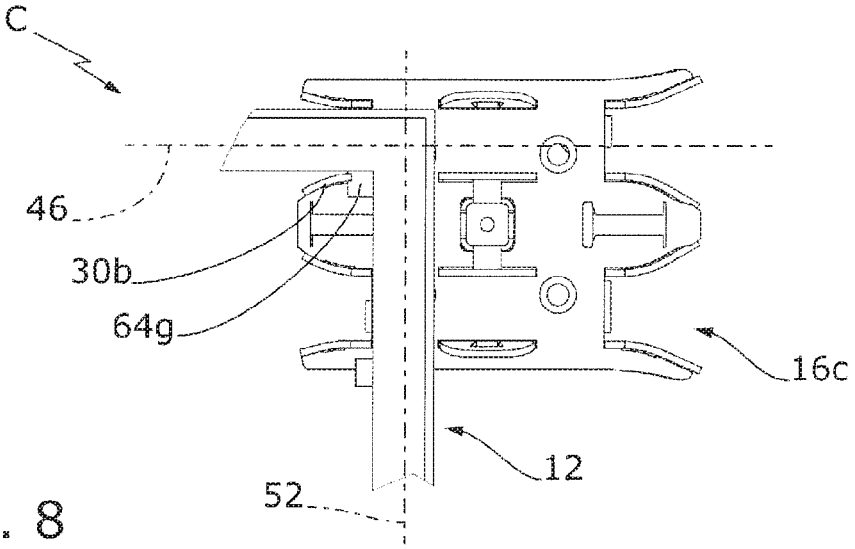
FIG. 8 shows an enlarged view of area C from FIG. 5.

FIG. 8 shows an enlarged detail C from FIG. 5. It is apparent from FIG. 8 that the formwork element 12 is positioned in the first channel guide 46 and in the fourth channel guide 52. The connecting protrusion 64*g* is engaged from behind by the second guide tab 30*b*, so that the support head 16*c* is securely fastened to the formwork element 12 with protection against shifting.

Figure 9:
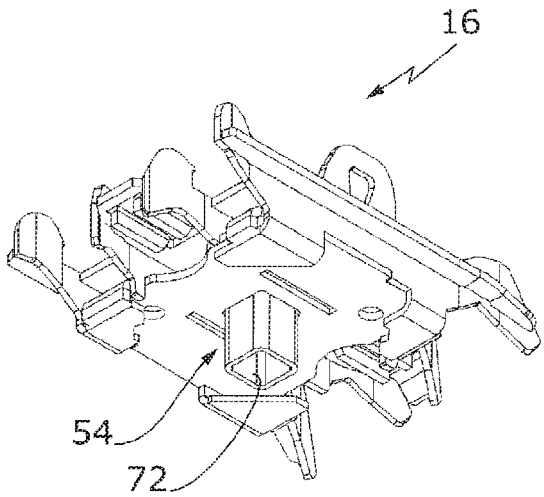
FIG. 9 shows a perspective bottom view of a support head.

FIG. 9 shows a perspective bottom view of the support head 16. The support head 16 includes the connecting area 54. The support head 16 has a tube 72 in the connecting area 54.

Figure 10:
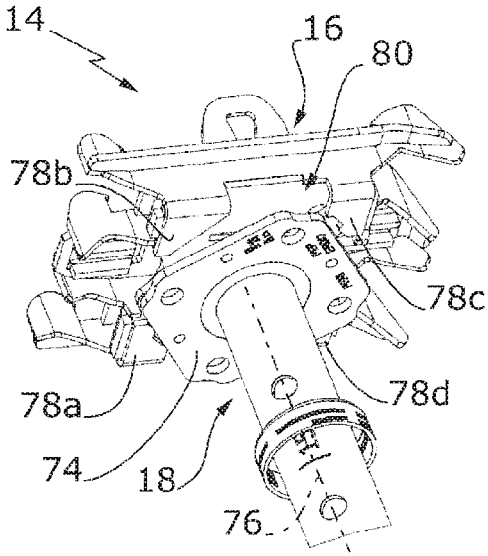
FIG. 10 shows a perspective bottom view of a ceiling support together with a support head and a formwork support, before they are installed.

FIG. 10 shows the ceiling support 14 according to FIG. 1 during mounting thereof. The ceiling support 14 has the support head 16 and a formwork support 18. The tube 72 (see FIG. 9) is at least partially, in particular completely, inserted into the formwork support 18. The formwork support 18 has a connecting plate 74. The connecting plate 74 is partially insertable into connecting tabs 78*a-d* of the support head after rotation about the longitudinal axis 76 of the formwork support 18. The connecting area 54 (see FIG. 9) forms a bayonet receptacle 80 as a result of the connecting tabs 78*a-d*.

Figure 11:
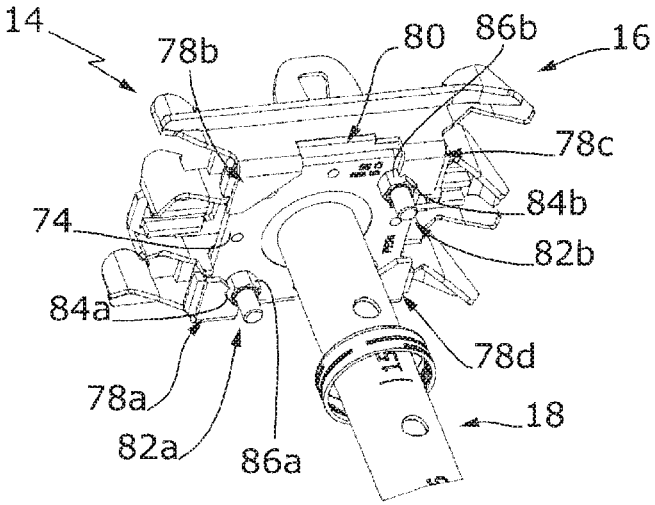
FIG. 11 shows a perspective bottom view of the ceiling support from FIG. 9, after installation.

FIG. 11 shows the ceiling support 14 in the mounted state. For anti-twist protection of the connecting plate 74 in the bayonet receptacle 80, the ceiling support 14 has at least one screw connection 82*a*, 82*b* between the formwork support 18 and the support head 16. At least one connecting tab 78*a-d*, in the present case the connecting tabs 78*a*, 78*c*, preferably has/have a recess, in the present case the recesses 84*a*, 84*b*, for locking a screw nut, in the present case the screw nuts 86*a*, 86*b*. The screw nuts 86*a*, 86*b* therefore do not have to be secured when the screw connections 82*a*, 82*b* are established.

Figure 12:
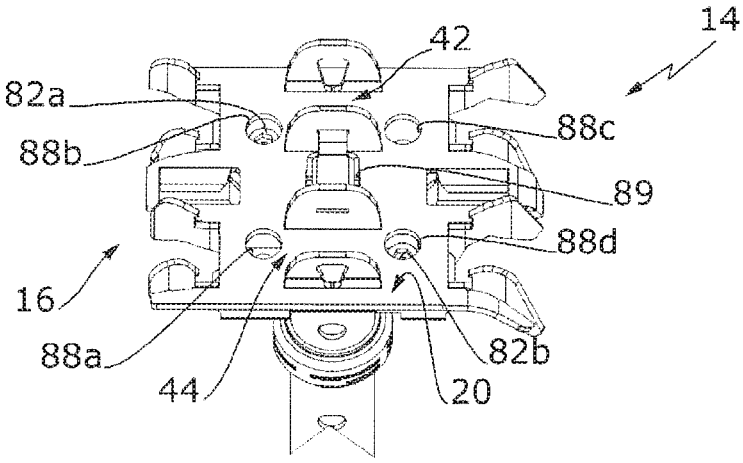
FIG. 12 shows a perspective top view of the ceiling support according to FIG. 10.

FIG. 12 shows the ceiling support 14 according to FIG. 11 in a top view. It is apparent from FIG. 12 that the support head 16 has through recesses 88*a-d* in the support plate 20 for placing the screws of the screw connections 82*a*, 82*b*.

For setting down a beam 90 (see FIGS. 13-15) in a center position of the beam 90, i.e., for additionally supporting the beam 90 away from its longitudinal side ends, a spacer protrusion 89 is provided on the support head 16. The spacer protrusion 89 is preferably part of the tube 72 (see FIG. 9). The spacer protrusion 89 is situated between the spacer tab pairs 42, 44.

Figure 13:
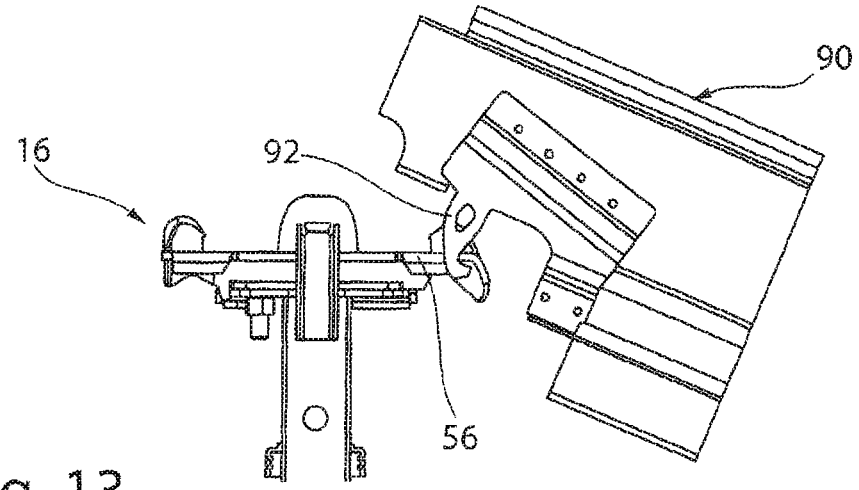
FIG. 13 shows a partially cutaway side view of a ceiling support and a beam to be mounted on the ceiling support.

FIG. 13 shows the support head 16 and a beam 90 to be situated on the support head 16. The beam 90 has a first hook 92 in the form of a curved finger. The first hook 92, with its end protruding from the beam 90, is inserted into the first beam insertion area 56.

Figure 14:
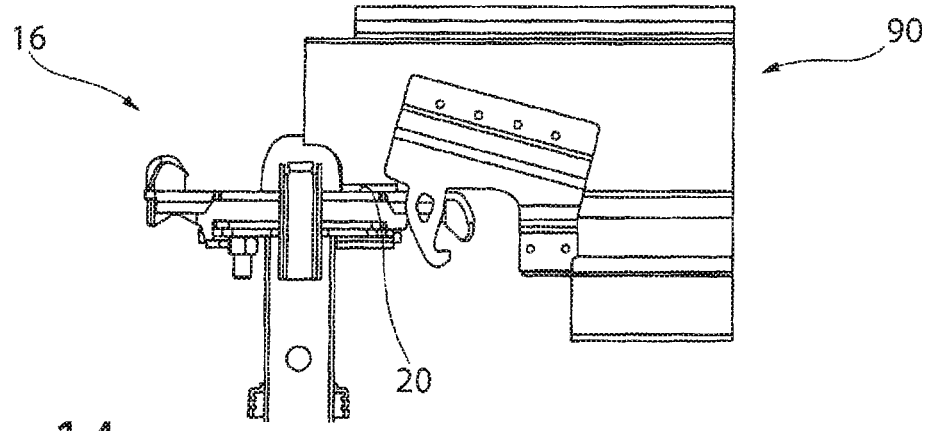
FIG. 14 shows a partially cutaway side view of the ceiling support according to FIG. 12, with the beam mounted on the ceiling support.

FIG. 14 shows the support head 16 with the beam 90 completely situated on the support head 16. The beam 90 is supported on the support plate 20.

Figure 15:
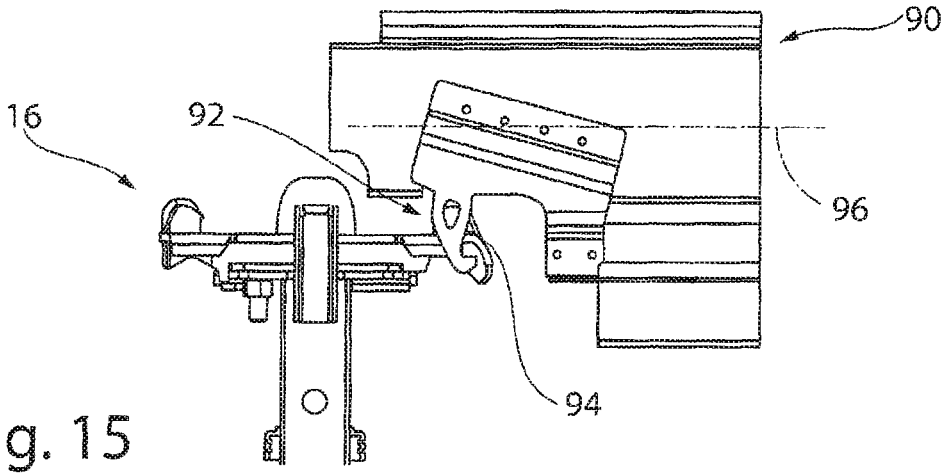
FIG. 15 shows a partially cutaway side view of the ceiling support according to FIG. 13, with the beam lifted up.

FIG. 15 shows the support head 16 with the beam 90 vertically lifted. It is apparent from FIG. 15 that the first hook 92 has an interior bevel 94 that is angled with respect to the longitudinal axis 96 of the beam 90. The bevel 94 is designed in such a way that the beam 90 in the mounted state is pulled by its weight force toward the center of the support head 16. The beam 90 may thus be mounted on the support head 16 with a clearance fit, resulting in a defined seat of the beam 90 relative to the support head 16 in the mounted state of the beam 90.

Figure 16:
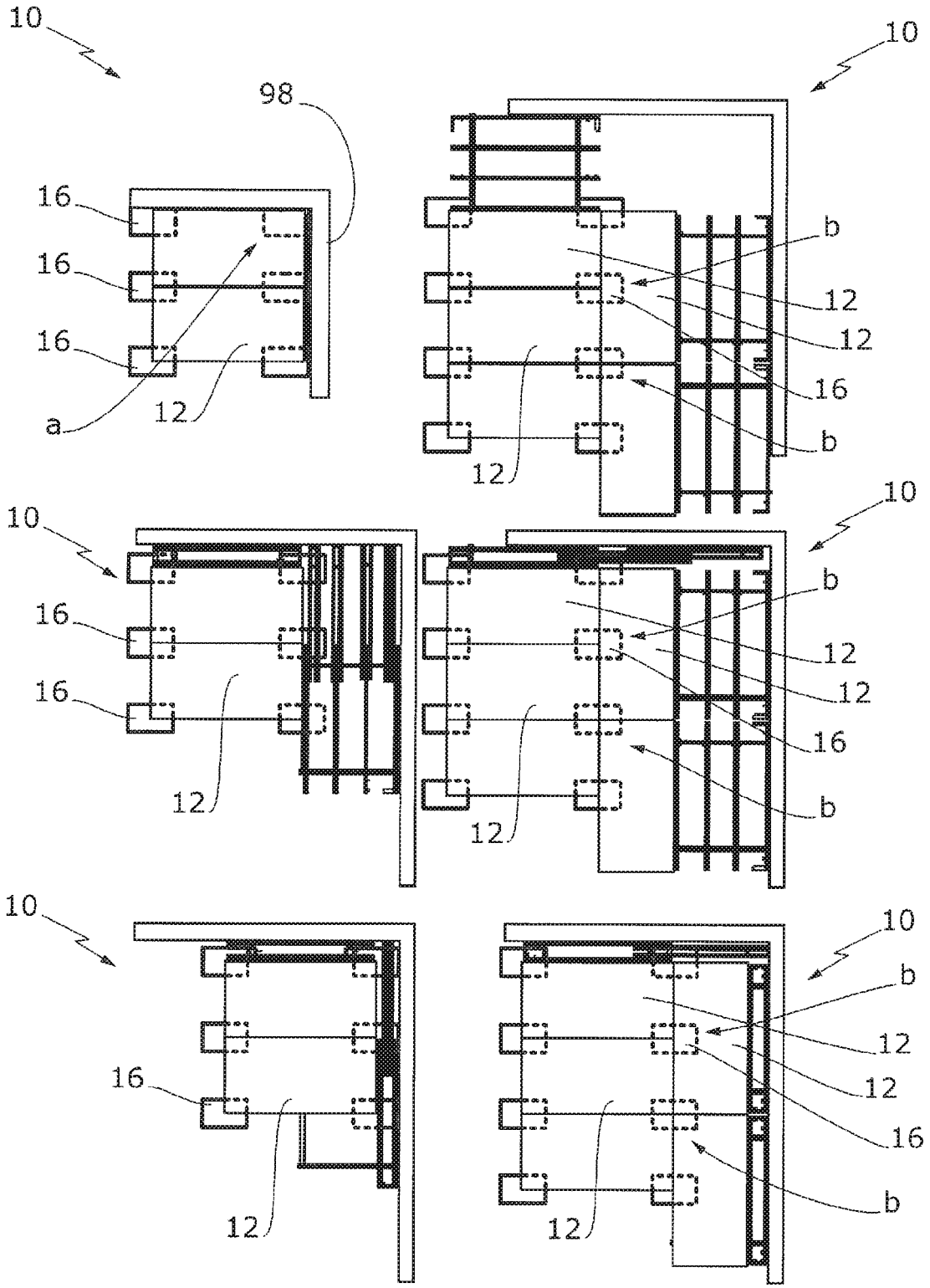
FIG. 16 shows a top view of various ceiling formworks.

FIG. 16 shows multiple ceiling formworks 10. The ceiling formworks 10 have multiple identical formwork elements 12 and multiple identical support heads 16, the support heads 16 being illustrated only schematically. In addition, only some of the support heads 16 are provided with a reference numeral for reasons of clarity. FIG. 16 illustrates the situation, among others, that only one formwork element rests on a support head 16 (see arrow a). The support head 16 is engaged (see the support head 16*a* according to FIG. 5), so that the formwork elements 12 may rest flush against a wall 98. The support heads 16 are designed for accommodating formwork elements 12 having different orientations. Adjacently situated formwork elements 12 may be rotated by 90° relative to one another on the support head 16 (see arrows b).

Considered in an overview of all figures of the drawing, the invention relates to a support head 16, 16*a-f* and a ceiling support 14. The support head 16, 16*a-f* in particular has a plate-shaped design and has multiple guide tabs 26*a-d*, 30*a-d*. The guide tabs 26*a-d*, 30*a-d* are arranged or provided in such a way that a formwork element 12 may be placed on the support head 16, 16*a-f* so as to prevent shifting, preferably at various positions. The support head 16, 16*a-f* has widely opened first guide tabs 26*a-d* that are situated opposite from less widely opened guide tabs 30*a-d*. This asymmetry of the support head 16, 16*a-f* allows the support head 16, 16*a-f* to be situated close to a wall corner, while at the same time the formwork element 12 can be easily fastened. The support head 16, 16*a-f*, in addition to the guide tabs 26*a-d*, 30*a-d*, preferably has at least one beam insertion area 56, 60 with a lateral guide 58*a*, 58*b*, 62*a*, 62*b*, in particular in the form of lateral guide tabs. The guide tabs 26*a-d*, 30*a-d* and/or the beam insertion area 56, 60 are/is preferably arranged or provided on a support plate 20, wherein the top side of the support plate 20 facing away from a connecting area 54 of the support head 16, 16*a-f* forms a support plane 22. The invention further relates to a ceiling formwork 10 comprising such a support head 16, 16*a-f*, a formwork element 12, and/or a beam 90. In order to put up the ceiling formwork 10, a formwork element 12 with its first end is preferably suspended from below, between the first guide tabs 26*a-d* of two support heads 16, 16*a*, 16*d* that are fastened to formwork supports 18. Two further support heads 16, 16*c*, 16*f* that are fastened to formwork supports 18 are subsequently affixed to the formwork element 12 by means of the second guide tabs 30*a-d*. The formwork element 12 is subsequently swiveled up, and in the swiveled-up state may then be held by the ceiling supports 14.

The invention claimed is:

1. A support head for a ceiling support for a ceiling formwork, the support head comprising:

a) a connecting area in which the support head is connectable to a formwork support;

b) a support plane for supporting a formwork element of the ceiling formwork and/or a beam of the ceiling formwork; and c) guide tabs that protrude away from the connecting area, the guide tabs having a design that opens outwardly from the connecting area, wherein the guide tabs include first guide tabs on a first side of the support head, which have a design that is more widely opened than second guide tabs on a second side of the support head situated opposite from the first side, wherein the first guide tabs are arranged as a first guide tab pair and a second guide tab pair, and second guide tabs are arranged as a third guide tab pair and a fourth guide tab pair, wherein the first guide tab pair together with the third guide tab pair defines a first channel guide, and the second guide tab pair together with the fourth guide tab pair defines a second channel guide, wherein a flat, continuous frame section of a formwork element is selectively introducible into the first channel guide or the second channel guide to make surface contact with the support head.

2. The support head according to claim 1, wherein the guide tabs each have at least one protrusion for partially engaging behind a formwork element perpendicular to the support plane.

3. The support head according to claim 1, further comprising a first spacer tab pair between the first guide tab pair and the third guide tab pair, and a second spacer tab pair between the second guide tab pair and the fourth guide tab pair, wherein a space between the first guide tabs and the spacer tab pairs defines a third channel guide, and a space between the second guide tabs and the spacer tab pairs defines a fourth channel guide, wherein a flat, continuous frame section of a formwork element is introducible into the third channel guide and the fourth channel guide to make surface contact with the support head.

4. The support head according to claim 3, wherein a flat, continuous frame section of a formwork element is selectively introducible into the first channel guide, the second channel guide, the third channel guide, or the fourth channel guide at an equal perpendicular distance from the support plane.

5. The support head according to claim 1, wherein the channel guides are configured so that at least two formwork elements that are rotated by 90° relative to one another in their longitudinal orientation are introducible into the channel guides.

6. The support head according to claim 3, further comprising at least one spacer protrusion between the first spacer tab pair and the second spacer tab pair to space a beam introduced between the spacer tab pairs farther away from the support plane than a formwork element that is introduced into the first channel guide, the second channel guide, the third channel guide, or the fourth channel guide.

7. The support head according to claim 1, further comprising a first beam insertion area between the first guide tab pair and the second guide tab pair for partially accommodating a beam of the ceiling formwork, the first beam insertion area having lateral guides for tilt stabilization of the beam, and further comprising a second beam insertion area between the third guide tab pair and the fourth guide tab pair for partially accommodating a beam of the ceiling formwork, the second beam insertion area having lateral guides for tilt stabilization of the beam.

8. A support head for a ceiling support for a ceiling formwork, the support head comprising:

a) a connecting area in which the support head is connectable to a formwork support;

b) a support plane for supporting a formwork element of the ceiling formwork and/or a beam of the ceiling formwork; and c) guide tabs that protrude away from the connecting area, the guide tabs having a design that opens outwardly from the connecting area, wherein the guide tabs include first guide tabs on a first side of the support head, which have a design that is more widely opened than second guide tabs on a second side of the support head situated opposite from the first side, wherein the connecting area has a bayonet receptacle for fastening a connecting plate of the formwork support by a bayonet connection.

9. The support head according to claim 8, wherein the bayonet receptacle has anti-twist protection for a connecting plate.

10. A ceiling support, comprising: a support head according to claim 1; and a formwork support situated on the support head.

11. A ceiling formwork, comprising: a ceiling support according to claim 10; and a formwork element situated on the ceiling support, and/or a beam situated on the ceiling support.

12. The ceiling formwork according to claim 11, wherein the first guide tabs are arranged as a first guide tab pair and a second guide tab pair, and second guide tabs are arranged as a third guide tab pair and a fourth guide tab pair, the support head further comprising a first beam insertion area between the first guide tab pair and the second guide tab pair for partially accommodating a beam of the ceiling formwork, the first beam insertion area having lateral guides for tilt stabilization of the beam, and further comprising a second beam insertion area between the third guide tab pair and the fourth guide tab pair for partially accommodating a beam of the ceiling formwork, the second beam insertion area having lateral guides for tilt stabilization of the beam, wherein the beam has a hook formed as a curved finger at each of two lengthwise ends, a first of the hooks being inserted into the first beam insertion area.

13. A method for putting up a ceiling formwork having a formwork surface made up of multiple formwork elements, comprising the steps of:

providing two ceiling supports that each have a support head with a ceiling support for a ceiling formwork, the support head comprising:

a) a connecting area in which the support head is connectable to a formwork support;

b) a support plane for supporting a formwork element of the ceiling formwork and/or a beam of the ceiling formwork; and c) guide tabs that protrude away from the connecting area, the guide tabs having a design that opens outwardly from the connecting area, wherein the guide tabs include first guide tabs on a first side of the support head, which have a design that is more widely opened than second guide tabs on a second side of the support head situated opposite from the first side, and a formwork support situated on the support head;

supporting the formwork surface at a corner of the formwork surface with a first of the ceiling supports so that a formwork shell at least virtually completely covers the support head in a top view; and supporting the formwork surface at an edge or another corner with a second of the ceiling supports so that the formwork shell covers the support head at most up to a center of the connecting area.

* * * * *